US006746993B2

(12) United States Patent
Yuki et al.

(10) Patent No.: US 6,746,993 B2
(45) Date of Patent: Jun. 8, 2004

(54) VISCOSITY INDEX IMPROVER AND LUBE OIL CONTAINING THE SAME

(75) Inventors: Tsuyoshi Yuki, Kyoto (JP); Yoshihisa Ota, Kyoto (JP)

(73) Assignee: Sanyo Chemical Industries, Ltd., Kyoto (JP)

( * ) Notice: Subject to any disclaimer, the term of this patent is extended or adjusted under 35 U.S.C. 154(b) by 0 days.

(21) Appl. No.: 10/212,784

(22) Filed: Aug. 7, 2002

(65) Prior Publication Data

US 2003/0104955 A1 Jun. 5, 2003

Related U.S. Application Data

(63) Continuation-in-part of application No. 10/114,283, filed on Apr. 3, 2002, now abandoned.

(30) Foreign Application Priority Data

Apr. 6, 2001 (JP) ..... 2001-109164

(51) Int. Cl.[7] ..... C10M 145/14; C08F 118/02

(52) U.S. Cl. ..... 508/469; 508/470; 526/319; 526/320

(58) Field of Search ..... 508/469, 321, 508/325, 320, 319

(56) References Cited

U.S. PATENT DOCUMENTS

| | | | | | |
|---|---|---|---|---|---|
| 4,956,111 | A | * | 9/1990 | Wilburn et al. | 508/469 |
| 5,043,087 | A | * | 8/1991 | Pennewiss et al. | 508/469 |
| 5,188,770 | A | * | 2/1993 | Pennewiss | 508/469 |
| 5,622,924 | A | | 4/1997 | Sakai et al. | 508/469 |
| 5,756,433 | A | * | 5/1998 | Auschra et al. | 508/469 |
| 5,891,831 | A | | 4/1999 | Matsuya et al. | 508/472 |
| 5,955,405 | A | * | 9/1999 | Liesen et al. | 508/469 |
| 6,124,249 | A | * | 9/2000 | Seebauer et al. | 508/469 |
| 6,255,261 | B1 | * | 7/2001 | Liesen et al. | 508/469 |
| 6,271,184 | B1 | * | 8/2001 | Seebauer et al. | 508/469 |
| 6,323,164 | B1 | * | 11/2001 | Liesen et al. | 508/469 |
| 6,391,996 | B1 | * | 5/2002 | Scherer et al. | 526/323.1 |
| 6,403,745 | B1 | * | 6/2002 | Scherer et al. | 526/319 |
| 6,458,749 | B2 | * | 10/2002 | Kinker et al. | 508/469 |
| 6,475,964 | B1 | * | 11/2002 | Neudoerfl et al. | 508/469 |

FOREIGN PATENT DOCUMENTS

JP 2001-288487 10/2001

* cited by examiner

*Primary Examiner*—Ellen M. McAvoy
(74) *Attorney, Agent, or Firm*—Westerman, Hattori, Daniels & Adrian, LLP

(57) ABSTRACT

Viscosity index improvers, are disclosed, comprising the following polymer (A1) or (A0).

Polymer (A1) has a solubility parameter of 8.6–9.4, a crystallizing initiation temperature of −15° C. or less and a steric hindrance factor (F) of 0–13, and comprises units of at least one of (a) $C_{1-40}$alkyl group-containing (meth)acrylates, (b) alkyl alkenyl ethers, (c) alkenyl carboxylates and (d) nitrogen-containing unsaturated monomers.

Polymer (A0) comprises units of a branched $C_{20-40}$alkyl group-containing (meth)acrylate (a0) capable of providing a homopolymer having a Tc of 5° C. or less and units of another alkyl (meth)acrylate.

Monomers, 2-decyl-tetradecyl methacrylate and 2-decyl-tetradecyl acrylate, are also described, suitable for producing polymers for viscosity index improvers.

18 Claims, 3 Drawing Sheets

$^1$H−NMR $^1$H-NMR $^{13}C$-NMR

VISCOSITY INDEX IMPROVER AND LUBE OIL CONTAINING THE SAME

This application is a continuation-in-part of application Ser. No. 10/114,283, filed Apr. 3, 2002 now abandoned.

BACKGROUND OF THE INVENTION

1. Field of the Invention

This invention relates to a viscosity index improver (hereinafter referred to as VII or VI improver). More particularly, it relates to a VII for lube oils, such as automatic transmission fluids (ATF), gear oils, hydraulic fluids and engine oils.

2. Description of the Prior Art

As VI improvers to improve viscosity index (hereinafter referred to as VI) of lube oils, there have been known heretofore copolymers of $C_{1-18}$alkyl (meth)acrylates (for instance, U.S. Pat. No. 5,622,924).

The term "(meth)acrylate" represents acrylate and/or methacrylate and also "$C_{1-18}$alkyl" represents alkyl group containing 1–18 carbon atoms; and similar expressions are used hereinafter.

SUMMARY OF THE INVENTION

It is an object of the present invention to provide a VII capable of imparting an improved VI to a lube oil.

It is another object of this invention to provide a VII capable of imparting an improved low temperature viscosity characteristics to a lube oil.

It is still another object of the invention to provide a VII having an improved shear stability.

It is yet another object of the present invention to provide a high VI lube oil having an improved shear stability.

It is further object of the present invention to provide an automotive lube oil capable of meeting fuel cost-saving requirement of an automobile.

It is still further object of the present invention to provide a monomer suitable for producing a VII.

Briefly, these and other objects of this invention as hereinafter will become more readily apparent have been attained broadly by a VII, comprising a polymer (A1) or (A0) as follows.

Polymer (A1) has a solubility parameter (hereinafter referred to as SP) of 8.6–9.4, a crystallizing initiation temperature (hereinafter referred to as Tc) of at most −15° C. and a steric hindrance factor F, defined by the following equation (1), within the range of 0–13.

$$F=4X+Y \tag{1}$$

In the equation (1), X and Y represent the total atom numbers at the 6th position and the 7th position, respectively, in the side chain(s), counted from the backbone.

Polymer (A1) comprises units of at least one monomer selected from the group consisting of the following monomers (a)–(d):

(a) $C_{1-40}$alkyl group-containing (meth)acrylates, (b) alkyl alkenyl ethers, (c) alkenyl carboxylates, and (d) nitrogen-containing unsaturated monomers.

Polymer (A0), used in another aspect of the invention, comprises units of at least one branched $C_{20-40}$alkyl group-containing (meth)acrylate (a0) and units of at least one other alkyl (meth)acrylate. Said (meth)acrylate (a0) is capable of providing a homopolymer having a Tc of at most 5° C.

Polymers (A1) and (A0), hereinafter generically referred to as Polymers (A), have a weight-average molecular weight (hereinafter referred to as Mw) of usually 5,000–2,000,000.

DETAILED DESCRIPTION OF THE PREFERRED EMBODIMENTS

Constituent Monomers of Polymers (A)

Figure 1:
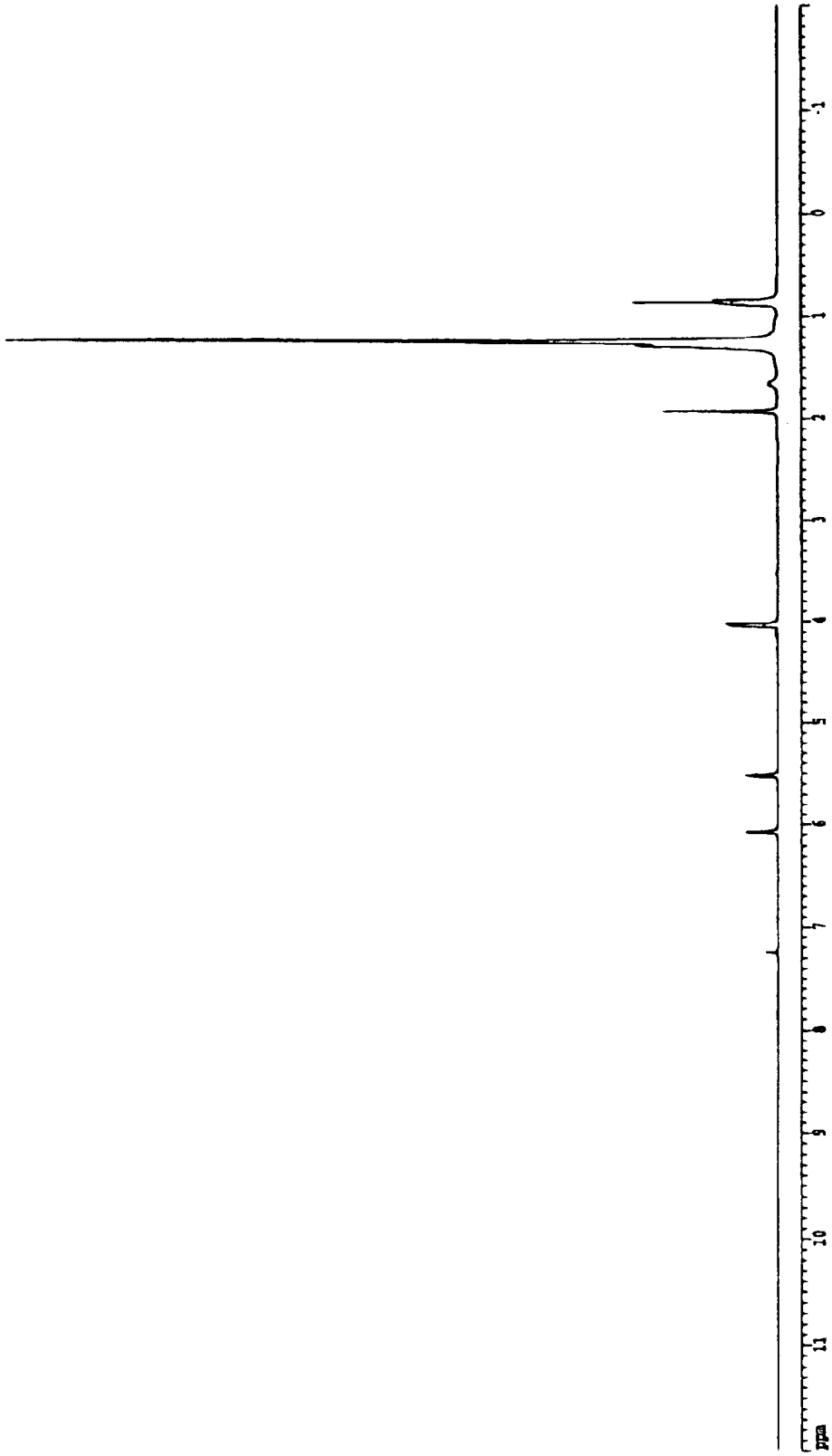
FIG. 1, FIG. 2 and FIG. 3, respectively, show $^{1}$H-NMR spectrum, $^{13}$C-NMR spectrum and IR spectrum, of 2-decyl-tetradecyl methacrylate.

Monomers (a), (b) and (c), constituting Polymer (A1), include ones represented by the general formulae (2), (3) and (4), respectively.

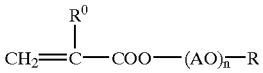

(2)

$$R—O—D \tag{3}$$

$$R—COO—D \tag{4}$$

In the general formulae (2), (3) and (4), $R^0$ is hydrogen atom or methyl group, R is a $C_{1-40}$alkyl group, n is 0 or an integer of 1–20 giving 0–10 on average, A is an $C_{2-4}$alkylene group; and D is an $C_{2-10}$alkenyl group.

$R^0$ is preferably methyl group.

Suitable $C_{1-40}$ alkyl groups R include 1) branched $C_{16-40}$ alkyl groups (hereinafter referred to as $R^1$), as mentioned below; 2) $C_{1-4}$alkyl groups ($R^2$), such as methyl, ethyl, n- and i-propyl, and n-, i-, sec- and t-butyl groups; 3) straight-chain and branched $C_{8-15}$alkyl groups ($R^3$), for example, n- and i-octyl, 2-ethylhexyl, n- and i-nonyl, n- and i-decyl, n-dodecyl, i-dodecyl (=2-methyl-undecyl), n-tridecyl, i-tridecyl (=2-methyldodecyl), n-tetradecyl, i-tetradecyl (=2-methyl-tridecyl), n-pentadecyl and i-pentadecyl (=2-methyl-tetradecyl) groups, alkyl residues of oxoalcohols (such as "NEODOL 23" and "NEODOL 45", produced by Shell Chemical Co., "DOBANOL 23" and "DOBANOL 45", produced by Mitsubishi Chemical Corp., and "OXOCOL 1213" and "OXOCOL 1415", produced by Nissan Chemical Industries, Ltd.), and alkyl residues of Ziegler alcohols; 4) straight-chain $C_{16-19}$alkyl groups ($R^4$), such as n-hexadecyl, n-octadecyl and n-nonadecyl groups; 5) straight-chain $C_{20-40}$alkyl groups ($R^5$), such as n-eicosyl, n-docosyl, n-tetracosyl and n-octacosyl groups; and 6) straight-chain and branched $C_{5-7}$alkyl groups ($R^6$), such as n-, i-, sec- and neo-pentyl, n- and i-hexyl, 2-methylpentyl and n- and i-heptyl groups.

Suitable branched $C_{16-40}$alkyl groups $R^1$ have usually 1–12 branchings, preferably 1 branching, and include branched $C_{20-40}$ alkyl groups and branched $C_{16-19}$alkyl groups (hereinafter referred to as $R^{11}$ and $R^{12}$, respectively).

Illustrative of suitable groups $R^{11}$ are 1-alkyl groups, such as 1-ethyl-octadecyl, 1-hexyl-tetradecyl, 1-octyl-dodecyl, 1-butyl-eicosyl, 1-hexyl-octadecyl, 1-octyl-hexadecyl, 1-decyl-tetradecyl and 1-undecyl-tridecyl groups; 2-alkyl groups, such as 2-hexyl-tetradecyl, 2-ethyl-octadecyl, 2-decyl-tetradecyl, 2-undecyl-tridecyl, 2-octyl-hexadecyl, 2-hexyl-octadecyl, 2-dodecyl-hexadecyl, 2-tridecyl-pentadecyl, 2-decyl-octadecyl, 2-tetradecyl-octadecyl, 2-hexadecyl-octadecyl, 2-tetradecyl-eicosyl and 2-hexadecyl-eicosyl groups; 3-alkyl to 34-alkyl groups, such as 3-alkyl, 4-alkyl, 5-alkyl, 32-alkyl, 33-alkyl and 34-alkyl groups; as well as mixed alkyl groups containing one or more branched alkyl groups, such as alkyl residues of oxoalcohols corresponding to propylene oligomers (from heptamer to undecamer), ethylene/propylene (molar ratio 16/1–1/11) oligomers, iso-butylene oligomers (from pentamer to octamer), α-olefine ($C_{5-20}$) oligomers (from tetramer to octamer) and the like.

Examples of suitable groups $R^{12}$ include 2-alkyl groups, such as 2-hexyl-decyl, 2-hexyl-undecyl, 2-octyl-decyl, 2-octyl-dodecyl, 2-butyl-dodecyl, 2-butyl-tetradecyl, 2-methyl-octadecyl and 2-metyl-hexadecyl groups.

Among alkyl groups R in the formula (2), preferred in regard of VI and low viscosity even at low temperature are groups $R^1$ (particularly groups $R^{11}$). Among groups $R^{11}$, preferred are those of $C_{20-36}$, particularly of $C_{20-36}$, more particularly of $C_{22-28}$, especially of $C_{24-26}$. Preferable types of groups $R^1$ in this regard are 2-alkyl groups, represented by the general formula:

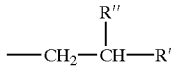

(5)

wherein R' and R" are the same or different straight-chain $C_{8-18}$ alkyl groups. The most preferred R' is dodecyl group. The most preferred R" is decyl group. The most preferred R is 2-decyl-tetradecyl group.

Among alkyl groups R in the general formulae (3) and (4), preferred are those of $C_{1-30}$, particularly of $C_{1-20}$.

In the general formula (2), n is 0 or an integer of 1–20 (preferably 1–10) giving 0–10 (preferably 0–5) on average, particularly 0. Suitable $C_{2-4}$alkylene groups A include ethylene, propylene, and 1,2-, 2,3-, 1,3- and 1,4-butylene groups; as well as combinations of two or more of these groups, in case of n being at least 2, which groups may be distributed random-wise and/or block-wise whithin the polyoxyalkylene moiety $(AO)_n$. Among alkylene groups, preferred are ethylene, propylene and combinations of them.

Preferable alkenyl groups D, in the general formulae (3) and (4) include ones of $C_{2-4}$, particularly of $C_{2-3}$, such as vinyl, (meth)allyl and (iso)propenyl groups.

Monomer (a)

Suitable (meth)acrylates (a), constituting Polymer (A1), include the following monomers (a0) to (a6).

Suitable (meth)acrylates (a0) and other (meth)-acrylates than (a0), constituting Polymer (A0), include the following monomers (a0) and (a1) to (a6), respectively.

Monomer (a0), represented by the general formula (2) wherein R is $R^{11}$, including (a01) branched $C_{20-40}$alkyl (meth)acrylates, such as 2-decyl-tetradecyl, 2-decyl-octadecyl, 2-dodecyl-hexadecyl, 2-octyl-dodecyl, 2-tetradecyl-octadecyl and 2-hexadecyl-eicosyl methacrylates (hereinafter referred to as DTM, DOM, DDHM, ODDM, TOM and HEM, respectively), and acrylates corresponding thereto, such as 2-decyl-tetradecyl acrylate (hereinafter referred to as DTA); and (a02) branched $C_{20-40}$alkoxy-$C_{2-4}$alkyl (meth)acrylates and branched $C_{20-40}$alkyl-polyoxyalkylene($C_{2-4}$) (meth)acrylates, such as 2-decyl-tetradecyl-oxyethyl methacrylate, diethylene glycol mono-2-decyl-tetradecyl ether methacrylate, dipropylene glycol mono-2-dodecyl-hexadecyl ether methacrylate and dibutylene glycol mono-2-dodecyl-hexadecyl ether methacrylate (hereinafter referred to as $DTE_1M$, $DTE_2M$, $DDHP_2M$ and $DDHB_2M$, respectively), dipropylene glycol mono-2-decyl-tetradecyl ether methacrylate and dibutylene glycol mono-2-decyl-tetradecyl ether methacrylate, and acrylates corresponding thereto;

Monomer (a1), represented by the general formula (2) wherein R is $R^{12}$, including (a11) branched $C_{16-19}$alkyl (meth)acrylates, such as 2-octyldecyl (meth)acrylates; and (a12) branched $C_{16-19}$ alkyoxy-alkyl($C_{2-4}$) (meth) acrylates and branched $C_{16-19}$alkyl-polyoxyalkylene($C_{2-4}$) (meth)-acrylates, such as 2-octyldecyl-oxyethyl methacrylate (hereinafter referred to as $ODE_1M$) and diethylene glycol mono-2-octyldecyl ether methacrylate, and acrylates corresponding to these methacrylates;

Monomer (a2), represented by the general formula (2) wherein R is $R^2$, including $C_{1-4}$alkyl (meth)acrylates, such as methyl acrylate, methyl methacrylate (hereinafter referred to as MM), and n-butyl (meth)acrylates;

Monomer (a3), represented by the general formula (2) wherein R is $R^3$, including (a31) $C_{12-13}$alkyl (meth)-acrylates, (a32) $C_{14-15}$ alkyl (meth)acrylates and (a33) $C_{8-11}$alkyl (meth)acrylates; for example, 2-ethylhexyl, n-decyl, n-dodecyl and n-tetradecyl methacrylates (hereinafter referred to as EHM, DM, DDM and TM, respectively), oxo-alcohol 1213 (mixture of alkanols of n–$C_{12}$/i–$C_{12}$/n–$C_{13}$/i–$C_{13}$=28/12/42/18 by weight) methacrylate and oxoalcohol 1415 (mixture of alkanols of n–$C_{14}$/i–$C_{14}$/n–$C_{15}$/i–$C_{15}$=42/18/28/12 by weight) methacrylate (hereinafter referred to as $OX_{23}M$ and $OX_{4\ 5}M$, respectively), and corresponding acrylates, such as n-dodecyl acrylate (hereinafter referred to as DDA);

Monomer (a4), represented by the general formula (2) wherein R is $R^4$, including straight-chain $C_{16-18}$alkyl (meth)acrylates, such as n-hexadecyl and n-octadecyl meth-acrylates (hereinafter referred to as HM and OM, respectively), and corresponding acrylates; Monomer (a5), represented by the general formula (2) wherein R is $R^5$, including straight-chain $C_{20-40}$alkyl (meth)acrylates, such as n-docosyl methacrylate (herein-after referred to as DSM), n-eicosyl and n-tetracosyl methacrylates, and corresponding acrylates; and Monomer (a6), represented by the general formula (2) wherein R is $R^6$, including $C_{5-7}$alkyl (meth)acrylates, such as n-pentyl, n-hexyl and 2-methylpentyl (meth) acrylates.

Among these, preferred are monomers (a0) and (a1), particularly monomers (a0). The most preferable is DTM.

Monomers (a0), having R11, are capable of providing a homopolymer having a Tc of 5° C. or less, preferably 0° C. or less, particularly −15° C. or less. Tc is measured with respect to a homopolymer prepared by the following method.

Into a reaction vessel equipped with a stirrer, a heating and cooling device, a thermometer, a dropping funnel and a nitrogen gas inlet tube, 25 pbw of toluene is charged and heated within an atmosphere of nitrogen to 85° C. While maintaining the temperature at 85° C., a mixture of 100 pbw of monomer, 0.3 pbw of dodecyl mercaptan (hereinafter referred to as Dm) and 0.5 pbw of 2,2'-azobis(2,4-dimethyl)-valeronitrile (hereinafter referred to as ADVN) is added thereto dropwise from the dropping funnel over 4 hours in the absence of air. The reaction mixture is held at 85° C. for 2 hours to proceed polymerization completely, followed by distilling off the toluene under reduced pressure at 130° C. for 3 hours to obtain a homopolymer. In the above and hereinafter, pbw represents part(s) by weight.

The following monomers provide each homopolymer having a Tc as follows:

| Monomer | DTM | TOM | DDHM | $DTE_1M$ | EHM | DSM |
|---|---|---|---|---|---|---|
| Tc, ° C. | −30 | 3 | −14 | −25 | <−40 | 45 |

There may be used two or more of these monomers (a0)-(a6), for instance, combinations of (a0) and/or (a1) with (a2) with or without (a3) and/or (a4), and combinations of (a0) and (a2) with or without one or more of (a1), (a3), (a4) and (a5).

Monomers (b), (c) and (d), which may be contained in Polymer (A1) instead of or in combination with said monomer (a) and may also be contained in Polymer (A0) in combination with said monomer (a0), include the followings.

Monomer (b)

$$R—O—D \tag{3}$$

Suitable alkyl alkenyl ethers (b) include, for example, alkyl vinyl ethers of the general formula (3), wherein D is vinyl and R is $R^2$, $R^3$, $R^4$ or $R^{12}$; and (meth)allyl ethers and (iso)propenyl ethers of the general formula (3), wherein D is (meth)allyl or (iso)propenyl group, corresponding to these vinyl ethers.

Among these ethers (b), preferred are vinyl ethers, particularly methyl vinyl ether, n-propyl vinyl ether and ethyl vinyl ether; and alkyl (meth)allyl ethers, particularly methyl allyl ether and ethyl allyl ether.

Monomer (c)

$$R—COO—D \tag{4}$$

Suitable alkenyl carboxylates (c) include, for example, ones of the general formula (4), wherein D and R are the same as in the monomers (b). Illustrative of suitable carboxylates (c) are vinyl acetate, vinyl propionate, vinyl butyrate, vinyl hexanoate, vinyl heptanoate, vinyl 2-ethylhexanoate and vinyl n-octanoate. Preferred are vinyl acetate and vinyl propionate.

Monomer (d)

Suitable nitrogen-containing unsaturated monomers (d) are inclusive of (d1) amino-containing monomers, (d2) amide-containing monomers, and (d3) nitro-containing monomers.

Suitable monomers (d1) include (d11) aliphatic monomers containing at least one of primary, secondary and tertiary amino groups, for example, mono- and di-$C_{3-6}$alkenyl amines, as represented respectively by the general formulae $D—NH_2$ and D—NH—D, wherein D is an $C_{2-10}$alkenyl group the same as in the formula (3) (preferably $C_{3-6}$ alkenyl group), such as (di)(meth)allyl amines and crotyl amine; and amino-containing acrylic monomers, as represented respectively by the general formula:

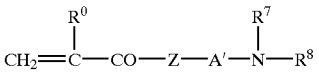

(6)

wherein $R^0$ is hydrogen atom or methyl group, Z is —O— or —NH—, A' is an $C_{2-6}$alkylene group, and $R^7$ and $R^8$ are independently selected from the group consisting of hydrogen atom and $C_{1-4}$alkyl groups, for instance, $C_{2-6}$aminoalkyl (meth)acrylates, such as aminoethyl and amino-propyl (meth)acrylates, mono- and di-$C_{1-4}$ alkyl-$C_{2-6}$amino-alkyl (meth)acrylates, such as (di)methyl-aminoethyl, (di) ethylaminoethyl, (di)butylaminoethyl and (di)methyl-aminopropyl (meth)acrylates, and (meth)acrylamides corresponding to these amino-containing (meth)acrylates; (d12) aromatic monomers containing at least one of primary, secondary and tertiary amino groups, for example, aminostyrenes, such as (dimethyl)aminostyrenes, phenylaminophenyl-(meth)-acrylamides, such as 4- and 2-phenylaminophenyl-(meth)-acrylamides; and (d13) amino-containing heterocyclic monomers, for example, heterocyclic amino group-containing acrylic monomers, as represented by the general formula (6), wherein $R^7$ and $R^8$ are joined together into a divalent group (such as $C_{4-5}$alkylene group or $—CH_2CH_2—O—CH_2CH_2—$), such as morpholino-$C_{2-4}$alkyl(meth)-acrylates, e.g. morpholinoethyl (meth)acrylates; and vinyl-substituted heterocyclic amines, such as vinylpyridines (e.g. 4- and 2-vinylpyridines), N-vinylpyrrole and N-vinylpyrrolidine; as well as (d14) salts of these amines (d1)-(d13), for instance, hydrochlorides, phosphates and $C_{1-8}$alkanoates, and (d15) quaternary ammonium saits of these amines (d11)-(d13), for example, ones quaternarized with $C_{1-8}$akyl halides (such as methyl chloride), benzyl halides (such as benzyl chloride), di-$C_{1-2}$ akylsulphates, di-$C_{1-2}$alkyl carbonates and the like.

Suitable amide-containing monomers (d2) include ones represented respectively by the general formula:

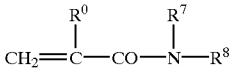

(7)

wherein $R^0$, $R^7$ and $R^8$ are the same as in the general formula (6), for example, (meth)acrylamide, N-mono-$C_{1-4}$alkyl- and N,N-di-$C_{1-4}$ alkyl-substituted (meth)acrylamide, such as (di) methyl, (di)ethyl, (di)i-propyl, (di)n-butyl and (di)i-butyl (meth)acrylamides; and N-vinyl-carbon-amides, such as N-vinylpyrrolidone, N-vinyl-formamide, N-vinylacetoamide, N-vinyl-n-and i-propionamide, and N-vinylhydroxyacetoamide.

Examples of nitro-containing monomers (d4) are nitrostyrenes, such as 4-nitrostyrene.

Among monomers (d), preferred are monomers (d1). More preferred are tertiary amino-containing acrylic monomers, particularly dimethylaminoethyl, diethylaminoethyl and morpholinoethyl methacrylates (hereinafter referred to as DMAEM, DEAEM and MOEM, respectively), and acrylates corresponding thereto.

Polymers (A) may further contain units of one or more additional monomers. Suitable additional monomers include, for example, the following monomers (e), (f), (g), (h), (i), (j) and (k).

Monomer (e): unsaturated $C_{2-20}$hydrocarbons, including (e1) unsaturated aliphatic $C_{2-20}$hydrocarbon monomers, for example, $C_{2-20}$alkenes, such as ethylene, propylene, butene, isobutylene, pentene, heptene, diisobutylene, octene, dodecene and octadecene; and $C_{4-12}$alkadienes, such as butadiene, isoprene, 1,4-pentadiene, 1,6-heptadiene and 1,7-octadiene; (e2) unsaturated alicyclic $C_{5-20}$hydrocarbon monomers, for example, cycloalkenes, such as cyclohexene; (di)cycloalkadienes, such as (di) cyclopentadiene; (bi)-cyclic terpenes, such as pinene and limonene; vinyl(di)-cycloalkenes, such as vinylcyclohexene; ethylidene-(di)cyclo-alkenes, such as ethylidenebicycloheptene and ethylidene-norbornene; and aromatic ring-containing cycloalkenes, such as indene; and (e3) unsaturated aromatic hydrocarbon monomers, for example, styrene, and homologues thereof, including $C_{1-20}$ hydrocabyl-substituted styrenes, such as α-methylstyrene, vinyltoluene, 2,4-dimethyl-styrene, 4-ethylstyrene, 4-iso-propylstyrene, 4-butyl-styrene, 4-phenylstyrene, 4-cyclohexyl-styrene, 4-benzyl-styrene and 4-crotylbenzene; and 2-vinyl-naphthalene.

Monomer (f): vinyl ketones, for example, $C_{1-10}$alkyl or $C_{6-8}$arkyl vinyl ketones, such as methyl vinyl ketone, ethyl vinyl ketone and phenyl vinyl ketone.

Monomer (g): epoxy-containing unsaturated monomers, for example, epoxy-containing acrylic monomers, such as glycidyl (meth)-acrylates; and epoxy group-containing $C_{2-10}$alkenyl (preferably $C_{3-6}$alkenyl) ethers, such as glycidyl (meth)allyl ethers.

Monomer (h): halogen-containing unsaturated monomers, for example, vinyl or vinilidene halides, such as vinyl chloride, vinyl bromide and vinylidene chloride; $C_{3-6}$alkenyl halides, such as (meth)allyl chloride; and halo-substituted styrenes, such as dichlorostyrenes.

Monomer (i): carboxyl-containing unsaturated monomers, for instance, (i1) unsaturated monocarboxylic acids, such as (meth) acrylic, α-methyl (meth) acrylic, (iso) crotonic and cinnamic acids; (i2) unsaturated dicarboxylic acids, such as maleic, fumaric, itaconic, citraconic and mesaconic acids; and (i3) mono-$C_{1-8}$alkyl ester of unsaturated dicarboxylic acid (i2), such as mono-alkyl maleates, mono-alkyl fumarates and mono-alkyl itaconates.

Monomer (j): hydroxyl-containing unsaturated monomers, for example, (j1) hydroxyl-containing aromatic unsaturated monomers, such as p-hydroxystyrene; (j2) hydroxyl-containing acrylic monomers, including (j21) $C_{2-6}$hydroxy-alkyl (meth)acrylates, such as 2-hydroxyethyl, 2-hydroxy-propyl and 3-hydroxypropyl (meth)acrylates; (j22) (meth)-acrylates of a polyhydric alcohol having 3–8 hydroxyl groups (for instance, alkane polyols and intramolecular of intermolecular dehydrates thereof, such as glycerol, trimethylolpropane, pentaerythritol, sorbitol, sorbitan and diglycerol; and saccharides and glycosides, such as sucrose and methyl glucoside), such as glycerol mono- and di-(meth)-acrylates; and (j23) hydroxyalkyl-substituted (meth) acryl-amides, as represented by the above general formula (7) wherein at least one of $R^7$ and $R^8$ is substituted with $C_{1-4}$hydroxyalkyl group, such as N,N-dihydroxymethyl (meth)acrylamide, N,N-dihydroxypropyl(meth) acrylamide and N,N-di-2-hydroxybutyl-(meth) acrylamide; (j3) alkenols, including vinyl alcohol, units thereof being obtained by hydrolysis of units of vinyl acetate; and $C_{3-12}$alkenols, such as isopropenols (propenyl alcohol and allyl alcohol), butenols (crotyl alcohol, 1-butene-3-ol and 1-butene-4-ol), 1-octenol and 1-undecenol; (j4) $C_{4-12}$alkenediols, such as 2-butene-1,4-diol; and (j5) hydroxyl-containing alkenyl ethers, having an $C_{3-10}$alkenyl group corresponding to (j3), such as propenyl, (meth)allyl and crotyl ethers, including $C_{1-6}$ hydroxyalkyl alkenyl ethers, such as 2-hydroxyethyl propenyl ether; and $C_{3-10}$alkenyl ethers of a polyhydric alcohol corresponding to (j22), such as trimethylolpropane mono- and di-(meth)allyl ethers and sucrose (meth) allyl ethers; as well as (j6) (poly)oxyalkylene ethers of these monomers (j1)-(j5), at least one hydroxyl group thereof having been substituted with $—(A0)_n—A—OH$ wherein A and n are the same as in the general formula (2).

Monomer (k): unsaturated esters other than the monomers (a) and (c), including $C_{1-40}$hydrocarbyl (such as alkyl, cyclo-alkyl and aralkyl) esters (preferably $C_{1-20}$alkyl esters) of an unsaturated dicarboxylic acid as mentioned in (i2), such as dimethyl, diethyl and dioctyl maleates, and fumarates and itaconates corresponding to these maleates.

Monomer Composition of Polymers (A)

Polymers (A1) contain units of at least one monomer selected from the group consisting of said monomers (a), (b), (c) and (d), with or without one or more of the above monomers (e)–(k), in such amounts providing an SP of 8.6–9.4, a Tc of −15° C. or less and a steric hindrance factor F of 0–13.

Polymers (A1) preferably contain units of at least one of the monomers (a) and (b) in an amount of at least 30%, particularly at least 50%, more particularly at least 80%. Among the monomers (a) and (b), preferred are (a) and combination thereof with (b). These monomers (a) and (b) are preferably used in a ratio of 3/7–10/0, particularly 5/5–10/0. In the above and hereinafter, % and ratio stand for % by weight and weight ratio, respectively, and % of monomer is based on the total weight of monomer(s), unless otherwise specified.

Polymers (A1) are preferably comprised of units of 0–45%, particularly 0–40% of said monomer (c); 0–12%, particularly 0–10% of said monomer (d); and 0–20%, particularly 0.1–10% of one or more of the monomers (e)–(k). In case of imparting detergency, it is preferred to use the monomer (d) (particularly DMAEM, DEAEM, MOEM and acrylates corresponding thereto) in an amount of at least 0.1%, particularly at least 0.5%.

Among polymers (A1) containing units of said monomer (a), preferred are polymers (A11), comprising units of at least one monomer selected from the group consisting of said monomers (a0) and (a1), represented by the general formula (2) wherein R is a branched $C_{20-40}$alkyl group $R^{11}$ and a branched $C_{16-19}$alkyl group $R^{12}$, respectively.

Polymers (A11) contain units of (a0) and/or (a1) in an amount of usually 5–90%, preferably 10–80%, particularly 10–60%, most particularly 10–45%. In general, polymers (A11) can contain units of 10–60%, preferably 20–50%, particularyly 20–45% of (a2); 0–85%, preferably 10–70%, particularly 10–60% of (a3) and/or (a4), particularly those having $C_{10-18}$alkyl group; preferably 0–20%, more preferably 0–10% of (a5) and/or (a6), particularly (a5); and up to 20%, preferably 0–10% of one or more other monomers of (b)–(k).

Other examples of suitable polymers (A1) containing units of said monomer (a) include polymers (A12), comprising units of 27–40% (preferably 28–38%) of (a2), preferably $C_{1-4}$alkyl (meth)acrylate(s) (particularly MM); 10–40% (preferably 15–35%) of (a31), preferably $C_{12-13}$alkyl (meth)acrylate(s) (particularly $OX_{23}M$); 10–40% (preferably 15–35%) of (a32), preferably $C_{14-15}$ alkyl (meth) acrylate(s) (particularly $OX_{4\ 5}M$); and 5–35% (preferably 10–30%) of at least one of (a0), (a1), (a4) and (a5), preferably $C_{16-24}$alkyl (meth)acrylate(s). Among $C_{16-24}$alkyl (meth)acrylates constituting polymers (A12), preferred are those of $C_{16-20}$alkyl (particularly a straight-chain alkyl) and combinations of two or more of these (meth)acrylates.

More preferred are combinations of $C_{16}/C_{18}$ (meth)acrylates (preferably 20–80/80–20) and combinations of $C_{16}/C_{18}/C_{20}$ (meth)acrylates (preferably 40–89.9/10–50/0.1–20).

Exemplery of other polymers among polymers (A1) containing units of said monomer (a) are polymers (A13), comprising units of 5–20% of (a2), 30–70% of (a3) and 5–20% of (a4).

Polymers (A0), in another aspect of the invention, comprise units of said monomer (a0), in an amount of generally at least 5%, preferably at least 10%, and usually 95% or less, preferably 90% or less, more preferably 80% or less, particularly 70% or less, more particularly 60% or less, most preferably 45% or less.

Polymers (A0) can contain units of at least one other alkyl (meth)acrylate than (a0), in an amount of usually at least 5%, preferably at least 20%, more preferably at least 30%, particularly at least 40%, more particularly at least 55%, and usually 95% or less, preferably 90% or less.

Said other alkyl (meth)acrylate than (a0) may be one or more of (a1), (a2), (a3), (a4), (a5) and (a6).

Polymers (A0) preferably contain 10–60%, particularly 20–50%, more particularly 25–45% of units of (a2). In general, polymer (A0) may contain 0–85%, preferably 5–70%, particularly 10–60% of units of one or more of (a1), (a3), (a4), (a5) and (a6), preferably (a3) and/or (a4) and combinations thereof with (a1) and/or (a5).

Among polymers (A0), preferred are those comprising units of 10–40% of (a0) (particularly DTM), 20–45% of (a2) (particularly MM), and 10–60% of (a3) and/or (a4) (preferably at least one of DM, DDM, TM, HM and OM, particularly DDM and/or HM).

Polymers (A0) can also contain, in addition to units of alkyl (meth)acrylates (a) comprising (a0), units of one or more other monomers. Suitable other monomers include monomers (b)–(k) as mentioned above. These monomers may be contained in the same amounts as in polymers (A1). That is, there may be used (b) in an amount providing a ratio of (a)/(b) within 3/7–10/0, particularly 5/5–10/0; (c) in an amount of 0–45%, particularly 0–40%; (d) in an amount of 0–12%, particularly 0–10%; and one or more of (e)–(k) in an amount of 0–20%, particularly 0.1–10% of. In case of imparting detergency, the monomer (d) (particularly DMAEM, DEAEM, MOEM and corresponding acrylates) is preferably used in an amount of at least 0.1%, particularly at least 0.5%.

Properties of Polymers (A)

Polymers (A) have a weight average molecular weight (Mw), as measured by gel permeation chromatography (GPC) using calibration curve of polystyrene, of generally at least 5,000, preferably at least 8,000, particularly at least 10,000, in view of capability of increasing viscosity at the minimum dose, and usually not higher than 2,000,000, preferably not higher than 500,000, particularly not higher than 250,000. When used as VII for ATF, polymers (A) preferably have an Mw of 10,000–35,000.

Polymers (A1) have an SP value, as determined by the Fedors method [Polym.Eng.Sci.14 (2) 152, (1974)], within the range of generally 8.6–9.4, preferably 9.0–9.35, particularly 9.1–9.3, in view of oil solubility and VI-improving ability.

In general, polymers (A1) have a Tc of generaly −15° C. or less, in view of providing excellent low temperature behavior of oils without being crystallized at low temperature. Preferably, polymers (A1) have a Tc of −17.5° C. or less, particularly −20° C. to −70° C., more particularly −35° C. to −70° C. Tc, in the present invention, is determined according to differential scanning calorimetry (DSC). DSC can be carried out with a differential scanning calorimeter (such as "UNIX DSC7", produced by PERKIN-ELMER Corp.), by applying 5 mg of a sample polymer and cooling it down from 100° C. to −45° C. at a uniform rate of −10C/minute to measure the crystallizing initiation temperature (Tc).

Polymers (A1) have a steric hindrance factor F, defined the equation (1), in the range of generally 0–13, preferably 0–12.5, more preferably 0–10, particularly 0–8, more particularly 0–7, in view of lower steric hindrance and providing oils of lower viscosity at low temperature and higher VI.

Steric hindrance factor F of a polymer is defined by the sum of four times X and Y, wherein X and Y represent the total numbers of atoms at the 6th position and at the 7th position, respectively, in the side chain contained in the constituent monomer unit of the polymer. The 6th position and the 7th positions are counted from the polymer backbone. If the constituent monomer unit has plural side chains, atoms at the 6th position and atoms at the 7th position in these side chains are totally calculated within X and Y, respectively. In case of a copolymer, steric hindrance factors of each monomer unit in the copolymer are averaged in proportion to the molar fractions of each monomer unit to determine steric hindrance factor F of the copolymer.

Calculation examples of steric hindrance factor F are given below. In the following structural formulae, the number at the right shoulder of each symbol of element represents the ordinal number of the position, counted from the backbone which is designated with the number 0. Atoms at the 6th position and atoms at the 7th position are designated with the number 6 and 7, respectively.

1) monomer unit of DTM
X = 6, Y = 6, F = 6 × 4 + 6 = 30

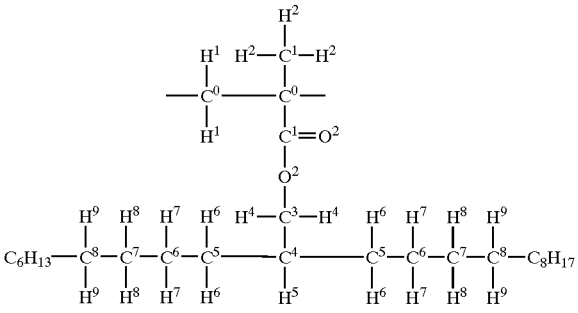

2) monomer unit of $DTE_2M$
X = 1, Y = 3, F = 1 × 4 + 3 = 7

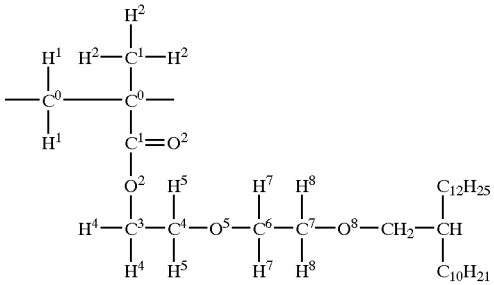

3) monomer unit of MM
X, Y = 0, F = 0 × 4 + 0 = 0

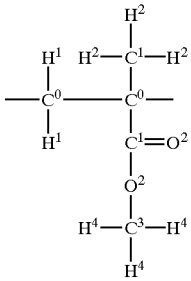

4) Copolymer of DTM/MM (Molar Ratio 40/60)

$F=30\times40/100+0\times60/100=12$

It is preferred that polymers (A0) also have the same SP, Tc and/or F, as specified in polymers (A1).

Polymers (A) preferably have an HLB of 0.5–6, particularly 1–5.5, more particularly 1.5–5, in view of demulsibility. HLB in this invention is Oda s HLB, defined based on a general concept of organic and inorganic natures of organic compounds ("New Introduction to Surface Active Agents" T. FUJIMOTO, SANYO CHEMICAL INDUSTRIES, LTD., pages 197–201).

Preparation of Polymers (A)

Polymers (A) can be prepared by known polymerization methods, for instance, solution polymerization, bulk polymerization, emulsion polymerization and suspension polymerization. Polymerization is usually carried out in the presence of a polymerization catalyst, with or without a chain transfer agent.

Suitable polymerization catalysts include, for example, azo catalysts, such as 2,2'-azobisisobutyro-nitrile, 2,2'-azobis(2-methyl)butyronitrile, ADVN and dimethyl 2,2-azobisisobutyrate; and peroxide catalysts, such as t-butyl peroxypivalate, t-hexyl peroxypivalate, t-butyl peroxyneoheptanoate, t-butyl peroxyneodecanoate, t-butyl peroxy-2-ethylhexanoate, t-butyl peroxyisobutyrate, t-amyl peroxy-2-ethylhexanoate, 1,1,3,3-tetramethylbutyl peroxy-2-ethylhexanoate, dibutyl peroxytrimethyladipate, benzoyl peroxide, cumyl peroxide and lauroyl peroxide.

Exemplery of suitable chain transfer agents are $C_{2-20}$alkyl mercaptans, such as dodecyl mercaptan (Dm); $C_{2-20}$mercapto-alkanoic acids, such as mercaptoacetic acid and mercaptopropionic acid; and $C_{2-20}$(polyoxy)alkylene dithiols, such as 1,4-butanedithiol and triethylene glycol dimercaptan.

It may be desirable to carry out polymerization within a solvent, that is, through solution polymerization. Illustrative of suitable solvents are hydrocarbon solvents, for example, aromatic solvents (aromatic $C_{6-15}$hydrocarbons, such as benzene, toluene, xylene, ethylbenzene, $C_{9-15}$alkylbenzenes, trimethylbenzene, ethyltoluene and mixtures of them), mineral oils (such as paraffinic oils, naphthenic oils, solvent-refined oils, isoparaffin-containing high VI oils and hydrocracked high VI oils), and synthetic hydrocarbon lubricants (such as poly-α-olefin synthetic lubricant); ketone solvents, such as butanone and methyl ethyl ketone; and ester solvents, including, fatty oils, and synthetic ester lubricants (for example, di-$C_{4-12}$alkyl $C_{4-12}$dicarboxylates, such as dioctyl sebacate and dioctyl adipate, polyol poly-$C_{4-12}$alkanoates, such as pentaerythritol tetra-caproate; and tri-$C_{4-12}$hydrocarbyl phosphates, such as tri-2-ethylhexyl phosphate, dibutyl phenyl phosphate, di-2-ethylhexyl phenyl phosphate, 2-ethylhexyl diphenyl phosphate and tricresyl phosphate).

In carrying out solution polymerization, it is preferred to use monomer(s), polymerzation catalyst and optionally chain transfer agent, at concentrations of 40–95% (particularly 60–90%), 0.1–5% (particularly 0.15–0.5%) and 0–5% (particularly 0–3%), respectively, based on the weight of the polymerization mixture.

Polymerization is carried out preferably at a temperature of 50–140° C., particularly 70–120° C.

Polymerization of two or more monomers can be done by random copolymerization or alternating copolymerizaton. Besides, graft copolymerization or block copolymerization may be employed. Preferred is random copolymerization.

Polymers (A) having a prescribed Mw, SP, Tc and F can be obtained by adequate selection of polymerization conditions. For instance, Mw can be adjusted by polymerization temperature, and quantities (concentrations) of monomers, solvent, catalyst and chain transfer agent. SP can be adjusted by selection of kinds (such as alkyl chain length) and molar ratio of monomers calculated from SP of each constitutent monomer (determined by Fedors method). For example, polymers of smaller SP can be obtained by using larger amount of monomer(s) having an alkyl group of longer chain length. Tc can be adjusted by length of polymethylene chains existing in the backbone and/or side-chains of polymer. For example, polymers of lower Tc can be produced by using larger amount of monomer(s) having shorter polymethylene chain(s) in alkyl side chain thereof. Polymers of smaller F can be obtained by using larger molar ratio of monomer(s) having smaller F (less number of atoms at the 6th and the 7th positions).

Viscosity Index Improvers

VI improvers according to the present invention comprises one or more polymers (A).

VI improvers may be comprised of a polymer (A0), or a combination thereof with a polymer (A1) other than (A0). Such a combination preferably contain polymers (A0) and (A1) other than (A0) in such a ratio of 100/0–20/80, particularly 100/0–70/30.

VI improvers of this invention can be solvent-free or may be in the form of a concentrate (or a solution in a solvent). Preferred are VI improvers in the form of a concentrate, because of being easily dissolved into oils.

VII concentrates include ones produced by solution polymerization and ones prepared by dissolving a polymer into a diluent.

Examples of suitable diluents include solvents as mentioned above, such as aromatic solvents and mineral oils; and (cyclo)aliphatic $C_{6-8}$hydrocarbons, such as hexane, heptane, cyclohexane, octane, decalin and kerosene. Among these, preferred are mineral oils.

VII concentrates preferably contains a polymer (A) in a concentration of 10–90%, particularly 30–80%, more particularly 50–70%, and a diluent in an amount of 10–90%, particularly 20–70%, more particularly 30–50%.

Lube Oil Compositions

Base oils, into which VII of the invention is added, are not particularly limited.

Base oils preferably have a kinematic viscosity (hereinafter referred to as KV) of 1–15 $mm^2/s$, particularly 2–5 $mm^2/s$, at 100° C.

Base oils preferably have a VI of at least 80 (particularly at least 100) and 150 or less (particularly 140 or less). Base oils preferably have a cloud point (defined in JIS K2269) of −5° C. or less, particularly −10° C. or less, more particularly −15° C. or less, in view of low-temperature viscosity behavior, with little wax deposition at low temperature.

Suitable base oil includes, for example, mineral oils, as mentioned above as the solvent for polymerization. Among these, preferred are high VI oils, particularly isoparaffin-containing high VI oils and hydrocracked high VI oils.

Suitable lube oils include, for example, engine oils (oils used in engines such as an engine for means of transportation and engine for machine tools); gear oils; transmission lube oils, particularly ATF, such as stepped automatic transmission fluid and continuously variable transmission fluid (CVTF); and traction oils, shock-absorber oils, power steering oils and the like.

In general, lube oil compositions contain added thereto a polymer (A) according to the present invention in an amount of 0.5–30%. For use as VII, polymer (A) is preferably added to oils in an amount of at least 1% particularly at least 2%.

For use as flow improver, the amount of polymer (A) may be lower than above.

Properties (such as viscosity) of base oils and content of polymer (A) added thereto may vary depending upon uses and requirements of lube oils and addition purpose of (A). Preferable ranges of KV of base oils and content of polymer (A) are as follows:

| | Content of (A) | Kinematic viscosity |
|---|---|---|
| Engine oil | 0.5–15% | 3–10 $mm^2/s$ at 100° C. |
| Gear oil | 3–30% | 3–10 $mm^2/s$ at 100° C. |
| ATF | 2–25% | 2–6 $mm^2/s$ at 100° C. |
| Traction oil | 0.5–15% | 1–5 $mm^2/s$ at 100° C. |
| Hydraulic oil | 0.5–25% | 1–10 $mm^2/s$ at 100° C. |

Lube oil compositions containing one or more polymers (A) [(A1) and/or (A0)] according to this invention, may further contain one or more copolymers [hereinafter referred to as Polymers (B)] of alkyl (meth)acrylates, other than polymers (A).

Polymers (B) are copolymers having units of monomers (a), free from any units of monomer (a0) or containing units of monomer (a0) in an amount of less than 5% or higher than 95%, or having at least one of SP, Tc, F and Mw being outside of the aforesaid ranges as defined in (A1).

Constituent monomers of polymers (B) include monomers selected from the group consisting of (a2), (a3), (a4), (a5), and (a6), as mentioned above.

Suitable polymers (B) include, for example, polymers (B1) comprising units of two or more monomers selected from the group consisting of (a2), (a3) and (a4), including copolymers of two or more of monomers (a3) and/or (a4) and copolymers of (a2) with (a3) and/or (a4).

Polymers (B1) preferably contain units of (a2) in an amount of 0–40% (particularly 5–35%) and the total of (a3) and (a4) in an amount of 60–100% (particularly 65–95%).

Polymers (B1) are preferably comprised of $C_{12-18}$alkyl (meth)acrylate units. Average number of carbon atoms in the alkyl group (hereinafter referred to as $C_{av}$) of all the alkyl (meth)acrylates constituting (B) is 12 to 16.

It is preferred that polymers (B) are mainly comprised of straight-chain alkyl (meth)acrylate units and may contain branched-alkyl (meth)acrylate units in a minor amount of 0–30%.

Illustrative of polymers (B1) are copolymers comprising units of (a3), (a4) and optionally (a2), for example, copolymers of 20–45% of DDM, 20–45% of TM, 0–20% of MM and 0–20% of HM, and copolymers of 10–50% of DDM and 50–90% of HM, having $C_{av}$ of 12.3–13.8; and copolymers comprising units of two monomers of (a3), for example, copolymers of 90–70% of DDM with 10–30% of TM, having $C_{av}$ of 12.2–12.6, and copolymers of 10–40% of DDA with 90–60% of DDM.

Polymers (B) preferably have an Mw of 5,000–1,000,000, particularly 10,000–250,000.

Polymers (B) can be prepared by the same method as mentioned above for preparation of (A), and may be used in the form of concentrates in the same manner as (A).

Polymers (A) and (B) may be added to a base oil separately or as a mixture of them.

Lube oil compositions can contain polymers (A) and (B) added thereto in an amount of 0.5–30% in total. Preferable ranges of the total amount of (A) and (B) are 0.5–15% (engine oil and traction oil), 3–30% (gear oil), 2–25% (ATF) and 0.5–25% (hydraulic oil).

Polymers (A) and (B) are preferably used in a ratio of at least 1/99, particularly 1/99–99/1, more particularly 10/90–90/10.

Lube oil compositions containing said polymer (A) or said polymers (A) and (B), may further contain optionally one or more other additives.

Such additives include ones usually used in lube oils. Illustrative of suitable additives are detergents, for example, basic or overbased, or neutral metal salts, such as overbased alkali or alkaline earth metal salts of sulfonates (petroleum sulfonates, alkylbenzene sulfonates, alkylnaphthalenesulfonates, and the like), phenates, naphthenates, salicylates, carbonates, phosphonates, and mixtures of two or more of them; dispersants, such as succinimides (bis- and mono-polybutenylsuccinimides and the like), Mannich dispersants, and borates; antioxidants, such as hindered phenols and secondary aromatic amines; friction modifiers, for example, long chain fatty acids and esters thereof (such as oleic acid and oleates), long chain amines and amides thereof (such as oleylamine and oleylamide); antiwear agents, for example, molybdenum and zinc compounds (such as molybdenum dithiophosphate, molybdenum dithio carbamate and zinc dialkyl dithiophosphate); extreme-pressure agents, for example, sulfur compounds (such as mono- and di-sulfides, sulfoxides and sulfur phosphide compounds), phosphide compounds, and chlorine compounds (such as chlorinated paraffins); antifoam agents, such as silicone oils, metallic soaps, fatty acid esters and phosphate compounds; demulsifying agents, for example, quaternary ammonium salts (such as tetraalkyl ammonium salts) sulfated oils, phosphate compounds (such as phoshates of polyoxyethylene-containing nonionic surfactant); and corrosion inhibitors, for example, nitrogen compounds (such as benzotriazole and 1,3,4-thiodiazoryl-2,5-bis dialkyl dithiocarbamate).

These additives can be used in such amounts as usually used, for instance, 0–20%, preferably 0.1–10% of detergent; 0–20%, preferably 2.0–10% of dispersant; 0–5%, preferably 0.1–3% of antioxidant; 0–5%, preferably 0.1–1% of friction modifier; 0–5%, preferably 0.1–3% of antiwear agent; 0–20%, preferably 1.0–10% of extreme-pressure agent; 2–1000 ppm, preferably 10–700 ppm of antifoam agent; 0–3%, preferably 0–1% of demulsifying agent; and 0–3%, preferably 0–2% of corrosion inhibitor.

2-Decyl-tetradecyl (Meth)Acrylates, and Polymers Thereof

In another aspect of the present invention, are provided monomers of DTM and DTA, and polymers comprising units of DTM and/or DTA.

DTM and DTA are presented by the general formula (2), wherein $R^0$ is methyl, group and hydrogen atom, respectively, n is 0, and R is 2-decyl-tetradecyl group presented by the general formula (5) wherein R' is n-dodecyl and R" is n-decyl.

DTM and DTA can be prepared by esterification of 2-decyl-tetradecyl alcohol (hereinafter referred to as DT) with (meth)acrylic acid, or by transesterification of DT with an $C_{1-4}$ alkyl (meth)acrylate (such as MM).

DT is commercially available, for example, under the trade name of "ISOFOL 24" from CONDEA Chemie GmbH.

Esterification and transesterification may be carried out, under usual ester-forming conditions. For example, DT and (meth)acrylic acid or a derivative thereof as above are charged, together with a catalyst for (trans)esterification, a polymerization inhibitor with or without a solvent, into a reactor, and are reacted under normal or reduced pressure at an elevated temperature of such as 70–140° C., preferably 100–120° C.

Suitable solvents include, for example, aromatic solvents and mineral oils as mentioned above. Preferred are aromatic ones, such as benzene, toluene and xylene. Exemplery of suitable polymerization inhibitors are phenol compounds (such as hydroquinone, hydroquinone monomethyl ether, p-benzoquinone, t-butyl cresol and catechol), phenothiazine, oxygen and air; as well as combinations of them. Suitable catalysts include, for example, acid catalysts, such as sulfuric, hydrochloric, methanesulfonic, benzenesulfonic, p-toluenesulfonic and xylene sulfonic acids; and base catalysts, such as sodium hydroxide, potassium hydroxide and sodium alcoholates.

After completion of the reaction, the resulting product is washed with water or an aqueous alkali solution, if necessary, and refined to removing the catalyst, the inhibitor or unreacted (meth)acrylic acid.

Polymers comprising units of DTM and/or DTA include homopolymers of DTM or DTA, copolymers of DTM and DTA, and copolymers of DTM and/or DTA with one or more other monomers, such as monomers (a)–(k) mentioned above. These polymers preferably contains units of DTM and/or DTA in an amount of at least 5%, and include polymers containing monomers (a)–(k) in the same range as in Polymer (A0) and polymers containing units of DTM and/or DTA in an amount larger than 95%.

These polymers preferably have an Mw of 5,000–1,000,000, particularly 10,000–250,000.

These polymers can be prepared by the same method as mentioned above for preparation of (A).

EXAMPLES

Having generally described the invention, a more complete understanding can be obtained with reference to certain specific examples, which are included for purposes of illustration only and are not intended to limit the scope of the present invention.

Measuring methods and conditions are as follows:

(1) Mw, measured by GPC under the following conditions:

Apparatus: HLC-802A, produced by Tosoh Corp.;

Column: TSKgel-GMH6, produced by Tosoh Corp., connecting two columns in series; Column Temperature: 40° C.;

Sample solution: 0.5% tetrahydrofuran solution;

Injection amount: 200 micro L;

Detector: a refractive index detector;

Standard: polystyrene, TSK STANDARD POLYSTYRENE, produced by Tosoh Corp.

Data processor: SC-8020, produced by Tosoh Corp.

(2) Viscosity, measured according to JPI-5S-26-85, at −40° C.

(3) VI, measured in accordance with JIS-K-2283.

(4) Shear stability, measured according to JASO M347-95, for test period of 12 hours, adjusting the liquid level every three hours.

Example I

Synthesis of DTM and Homopolymer Thereof

Into a 2 litter reaction vessel equipped with a thermometer, a stirrer, a condenser, a gas inlet tube and a dropping funnel, were charged 1000 pbw of DT, 1.1 pbw of hydroquinone and 4 pbw of a concentrated sulfuric acid, followed by heating them to 90° C. under stirring. Then, were added thereto 315.8 pbw of methacrylic acid dropwise over 2 hours with bubbling air/nitrogen mixture (½ by volume) at flow rate of 75 ml/minute while gradually increasing the temperature up to 120° C., followed by maintaining the temperature at 120° C. for two hours to complete the estrification. The esterified product was heated to 125° C. under reduced pressure of 4 kPa to remove unreacted methacrylic acid. Subsequently, 32 pbw of 10% aqueous solution of sodium hydroxide were added thereto under stirring at a temperature not exceeding 30° C. to neutralize acids (sulfuric acid, hydroquinone and methacrylic acid) remained in the product, followed by centrifuging the resulting mixture into two layers to separate the upper layer from the lower layer. To 1,132 pbw of the upper layer containing DTM thus prepared, were added 5 pbw of an adsorbent "KYOWAAD-500SH" (Kyowa Chemical Industry Co., Ltd.), followed by stirring them for an hour at 60° C. and then distiling off water contained therein.

Figure 2:
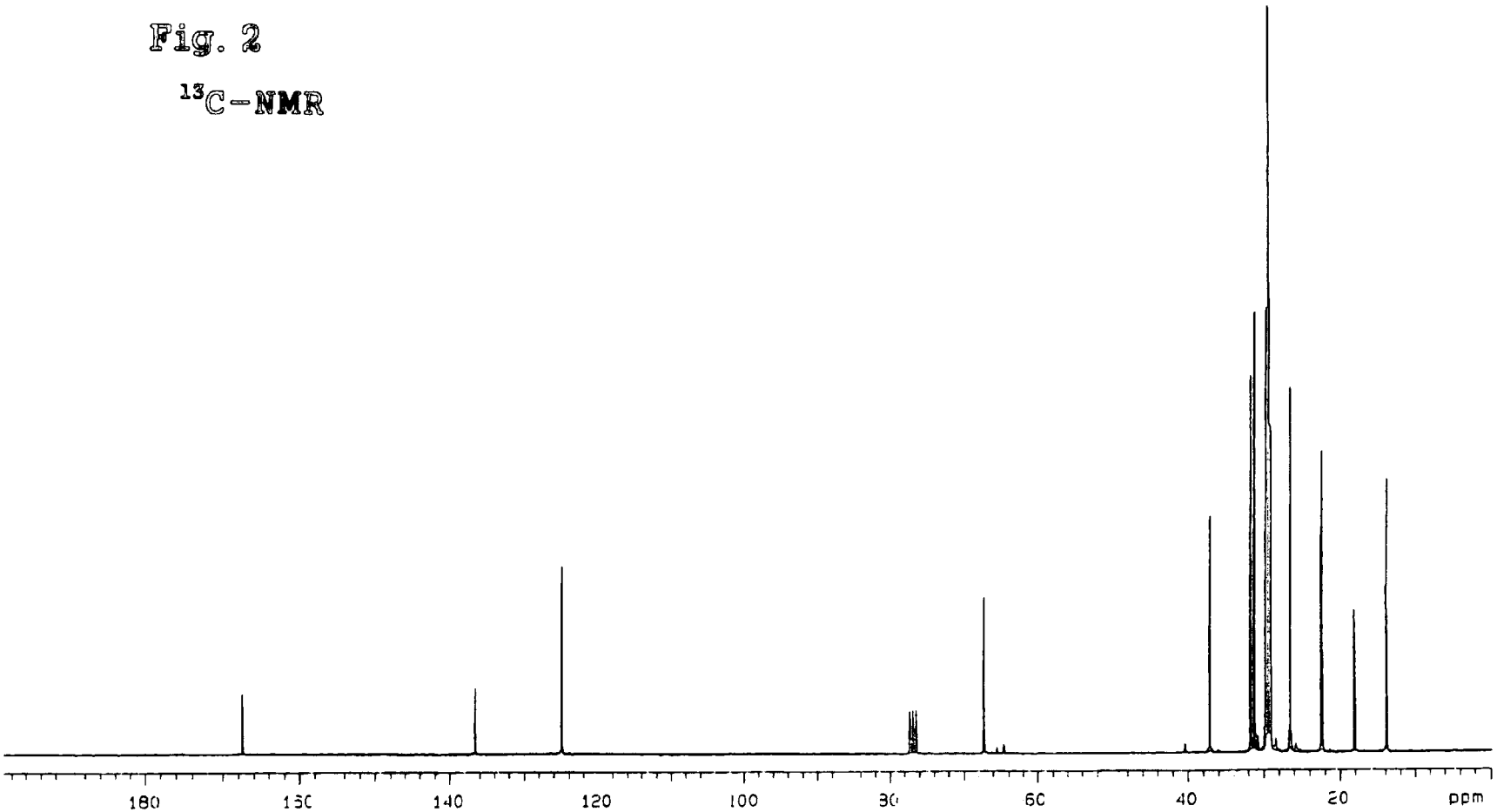
Figure 3:
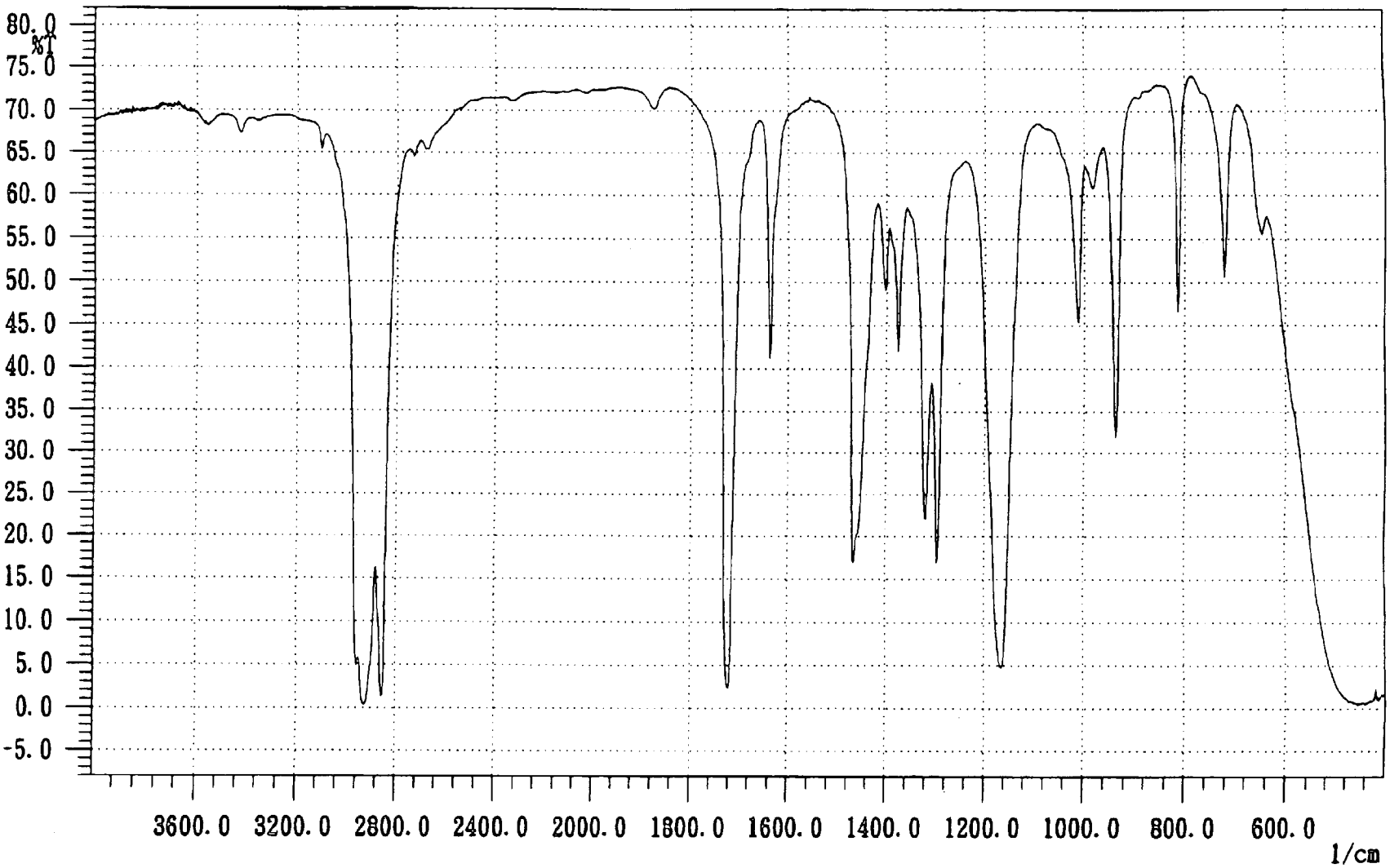

The resulting product was filtrated to remove solid impurities to obtain 1,100 pbw of DTM, having a solidifying point of −33° C. to −35° C. and having $^{1}$H-NMR spectrum ($CDCl_3$, 300 MHz), $^{13}$C-NMR spectrum ($CDCl_3$, 300 MHz) and IR absorption spectrum (NaCl) as shown in FIG. 1, FIG. 2 and FIG. 3, respectively.

The $^{1}$H-NMR spectrum shows resonance peaks, shapes, coupling constants and the number of hydrogen atoms as follows: δ 6.08 (s, 1H), 5.52 (s, 1H), 4.04 (d, J=6 Hz, 2H), 1.93 (s, 3H), 1.6–1.7 (m, 1H), 1.1–1.4 (m, 40H) and 0.87 (t, J=6 Hz, 6H). The $^{13}$C-NMR spectrum shows resonance peaks as follows: δ 167.6, 136.7, 125.0, 67.3, 37.2, 31.8, 31.3, 29.8, 29.6, 29.5, 29.5, 29.3, 26.6, 22.5, 18.1 and 13.9. The IR spectrum shows absorption frequencies as follows: 2924, 2855, 1720, 1639, 1466, 1319, 1296, 1165, 1013, 937, 814 and 721 $cm^{-1}$.

In accordance with the above-mentioned method of preparing a homopolymer for Tc measurement, DTM was polymerized to prepare a DTM homopolymer having Tc of −30° C. and Mw of 50,000.

Example II

DTA and a homopolymer thereof are prepared in the same manner as in Example I.

Examples 1–13

Polymers A-1 to A-9 and B-1 to B-4

Into a reaction vessel equipped with a stirrer, a heating and cooling device, a thermometer, a dropping funnel and a nitrogen gas inlet tube, toluene in an amount written in Table 1 was charged and heated within an atmosphere of nitrogen to 85° C. While maintaining the temperature at 85° C., a mixture of monomers, Dm and ADVN as shown in Table 1 was added thereto dropwise from the dropping funnel over 4 hours in the absence of air. The reaction mixture was held at 85° C. for 2 hours to proceed polymerization completely, followed by distilling off the toluene under reduced pressure at 130° C. for 3 hours to obtain Polymers A-1 to A-9 and Polymers B-1 to B-4, having properties as shown in Table 2.

Examples 14–16

Polymers A-10 to A-12

Example 1 was repeated except that the reaction mixture was held at 90° C. for 6 hours (Examples 14–16) and that the polymerized product was precipitated with methanol and then washed twice with methanol, followed by distilling off the solvent under reduced pressure at 100° C. for 4 hours to obtain Polymers A-10 to A-12, having properties as shown in Table 2.

TABLE 1

| Example No. | Monomers Kind | Monomers pbw | Dm pbw | ADVN pbw | Toluene pbw | Polymer No. |
|---|---|---|---|---|---|---|
| 1 | DTM/MM/HM/DMAEM | 32/36/30/2 | 0.9 | 0.5 | 25 | A-1 |
| 2 | DDHM/MM/DDM/HM | 20/36/32/12 | 0.9 | 0.5 | 25 | A-2 |
| 3 | $DTE_1M$/MM/DDM/HM | 20/32/38/10 | 0.9 | 0.5 | 25 | A-3 |
| 4 | DTM/MM/HM | 30/38/32 | 0.9 | 0.5 | 25 | A-4 |
| 5 | DDHM/MM/DDM/HM | 20/38/30/12 | 0.9 | 0.5 | 25 | A-5 |
| 6 | DTM/MM/DDM | 20/30/50 | 0.9 | 0.5 | 25 | A-6 |
| 7 | DTM/DDHM/MM/DDM/DEAEM | 30/10/35/23/2 | 0.9 | 0.5 | 25 | A-7 |
| 8 | DTM/MM/HM | 30/35/35 | 0.9 | 0.5 | 25 | A-8 |
| 9 | MM/DDM/HM | 20/70/10 | 0.9 | 0.5 | 25 | A-9 |
| 10 | OM/DDM | 20/80 | 0.3 | 0.4 | 25 | B-1 |
| 11 | EHM/DDM/DMAEM | 48/50/2 | 0.9 | 0.5 | 25 | B-2 |
| 12 | MM/DDM | 55/45 | 0.9 | 0.5 | 25 | B-3 |
| 13 | DSM/MM/HM | 40/30/30 | 0.9 | 0.5 | 25 | B-4 |
| 14 | $MM/OX_{2\ 3}M/OX_{4\ 5}M$/HM/OM | 30/25/25/14/6 | 1.0 | 0.47 | 17.6 | A-10 |
| 15 | MM/DDM/TM/HM/OM | 30/35/15/14/6 | 1.0 | 0.47 | 17.6 | A-11 |
| 16 | MM/DDM/TM/HM/OM/DSM | 28/40/20/7/3/2 | 1.0 | 0.47 | 17.6 | A-12 |

TABLE 2

| Example No. | Polymer No. | Mw | SP | Tc, ° C. | F | HLB |
|---|---|---|---|---|---|---|
| 1 | A-1 | $2 \times 10^4$ | 9.2 | <−40 | 7.2 | 3.1 |
| 2 | A-2 | $3 \times 10^4$ | 9.2 | <−40 | 6.6 | 3.2 |
| 3 | A-3 | $3 \times 10^4$ | 9.2 | <−40 | 5.6 | 3.2 |
| 4 | A-4 | $3 \times 10^4$ | 9.2 | <−40 | 6.6 | 3.1 |
| 5 | A-5 | $3 \times 10^4$ | 9.3 | <−40 | 6.2 | 3.3 |
| 6 | A-6 | $3 \times 10^4$ | 9.2 | <−40 | 8.0 | 3.0 |
| 7 | A-7 | $2 \times 10^4$ | 9.2 | <−40 | 7.9 | 3.1 |
| 8 | A-8 | $6 \times 10^4$ | 9.2 | <−40 | 7.5 | 3.1 |
| 9 | A-9 | $3 \times 10^4$ | 9.2 | <−40 | 9.1 | 2.7 |
| 10 | B-1 | $6 \times 10^4$ | 9.0 | −17 | 15.0 | 1.9 |
| 11 | B-2 | $2 \times 10^4$ | 9.0 | <−40 | 23.0 | 2.5 |
| 12 | B-3 | $3 \times 10^4$ | 9.5 | <−40 | 3.7 | 4.5 |
| 13 | B-4 | $3 \times 10^4$ | 9.2 | 19 | 6.0 | 2.7 |
| 14 | A-10 | $2.85 \times 10^4$ | 9.2 | −36 | 7.9 | 3.0 |
| 15 | A-11 | $2.86 \times 10^4$ | 9.2 | −35 | 6.9 | 3.1 |
| 16 | A-12 | $2.8 \times 10^4$ | 9.2 | <−40 | 7.3 | 3.0 |

Examples 17–26 and Comparative Examples 1–3 (VII Concentrates and Lube Oil Compositions)

By dissolving 65 pbw of each of Polymers A-1 to A-10 and B-1 to B-4 into 35 pbw of a mineral oil (solvent-refined oil having a KV of 2.4 $mm^2/s$ at 100° C.), were prepared VII concentrates, hereinafter referred to as Concentrates A1-1 to A1-10 and B1-1 to B1-4, respectively.

Into a stainless steel vessel equipped with a stirrer, was charged 0.5 pbw of Concentrate B-1, followed by adding thereto a base oil (having a KV of 3.0 $mm^2/s$ at 100° C. and a VI of 117) and each of Concentrates A1-1 to A1-10 and B1-2 to B1-4, respectively, in such an amount providing a lube oil composition of a KV in the range of 6.0±0.1 $mm^2/s$ at 100° C. as written in Table 3 to prepare lube oil compositions having VI, low temperature viscosity at −40° C. and shear stability as given in Table 3.

TABLE 3

| Example No. | Concentrate No. | Concentrate pbw | Base oil pbw | VI | Viscosity at −40° C. mPa.s | Shear stability |
|---|---|---|---|---|---|---|
| Example 17 | A1-1 | 17 | 82.5 | 229 | 9,900 | 10% |
| Example 18 | A1-2 | 17 | 82.5 | 232 | 10,000 | 10% |
| Example 19 | A1-3 | 17 | 82.5 | 231 | 10,000 | 10% |

TABLE 3-continued

| Example No. | Concentrate No. | Concentrate pbw | Base oil pbw | VI | Viscosity at −40° C. mPa.s | Shear stability |
|---|---|---|---|---|---|---|
| Example 20 | A1-4 | 17 | 82.5 | 232 | 9,500 | 10% |
| Example 21 | A1-5 | 17 | 82.5 | 232 | 9,800 | 10% |
| Example 22 | A1-6 | 17 | 82.5 | 229 | 8,800 | 10% |
| Example 23 | A1-7 | 17 | 82.5 | 228 | 9,900 | 10% |
| Example 24 | A1-8 | 13 | 86.5 | 263 | 5,200 | 25% |
| Example 25 | A1-9 | 17 | 82.5 | 218 | 7,000 | 10% |
| Example 26 | A1-10 | 17 | 82.5 | 222 | 11,000 | 10% |
| Comparative Example 1 | B1-2 | 17 | 82.5 | 208 | 11,000 | 12% |
| Comparative Example 2 | B1-3 | not dissolved | | — | — | — |
| Comparative Example 3 | B1-4 | 17 | 82.5 | 231 | >400,00 | 10% |

Examples 27–29

VII Concentrates and Lube Oil Compositions

By dissolving 50 pbw of each Polymer A-10 to A-12 into 50 pbw of a mineral oil (solvent-refined oil having a flash point of 160° C.), were prepared VII concentrates.

To a base oil (high-VI oil having a pour point of −22.5° C. and a KV of 3.0 $mm^2/s$ at 100° C. and a VI of 117), was added and dissolved therein each VII concentrate in such an amount providing a lube oil composition of a KV in the range of 6.1 $mm^2/s$ at 100° C. as written in Table 4 to prepare lube oil compositions having VI and shear stability as given in Table 4.

TABLE 4

| Example No. | Polymer No. | Concentrate pbw | Base oil pbw | VI | Shear stability |
|---|---|---|---|---|---|
| 27 | A-10 | 24 | 76 | 224 | 11.5% |
| 28 | A-11 | 24 | 76 | 225 | 11.4% |
| 29 | A-12 | 24 | 76 | 224 | 11.7% |

What is claimed as new and desired to be secured by Letters Patent is:

1. A viscosity index improver, which comprises a polymer (A1) having a solubility parameter of 8.6–9.4, a crystallizing initiation temperature of −15° C. or less, and a steric hindrance factor (F) of 0–13, said factor F being defined by the following equation:

$$F=4X+Y \quad (1)$$

wherein X and Y represent the total atom numbers at the 6th position and the 7th position, respectively, in the side chains, counted from the backbone; said polymer (A1) having a weight-average molecular weight of 5,000–2,000,000 and comprising units of at least one monomer selected from the group consisting of:

(a) a monomer represented by the general formula:

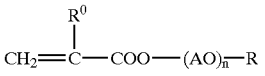

(2)

wherein $R^0$ is hydrogen atom or methyl group, R is a $C_{1-40}$alkyl group, n is 0 or an integer of 1–20 giving 0–10 on average, A is an alkylene group containing 2–4 carbon atoms, plural A's in case of n being at least 2 are the same or different, and the polyoxyalkylene moiety $(AO)_n$ in case of the plural A's being different comprises random-wise or block-wise distributed oxyalkylene groups, (b) an alkyl alkenyl ether, (c) an alkenyl carboxylate, and (d) a nitrogen-containing unsaturated monomer;

wherein said polymer (A1) is a polymer (A12), comprising units of 27–40% by weight of an alkyl acrylate or methacrylate (a2) containing 1–4 carbon atoms in the alkyl group, 10–40% by weight of an alkyl acrylate or methacrylate (a31) containing 12–13 carbon atoms in the alkyl group, 10–40% by weight of an alkyl acrylate or methacrylate (a32) containing 14–15 carbon atoms in the alkyl group, and 5–35% by weight of an alkyl acrylate or methacrylate containing 16–40 carbon atoms in the alkyl group.

2. A viscosity index improver, which comprises a polymer (A0) having a weight-average molecular weight of 5,000–2,000,000, comprising 5–95% by weight of units of at least one monomer (a0) and 5–95% by weight of units of at least one alkyl acrylate or methacrylate other than said monomer (a0): said monomer (a0) being capable of providing a homopolymer having a crystallizing initiation temperature of 5° C. or less and represented by the general formula:

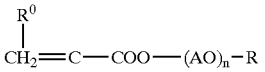

(2)

wherein $R^0$ is hydrogen atom or methyl group, R is a branched alkyl group containing 20–40 carbon atoms, n is 0 or an integer of 1–20 giving 0–10 on average, A is an alkylene group containing 2–4 carbon atoms, plural A's in case of n being at least 2 are the same or different, and the polyoxyalkylene moiety $(AO)_n$ in case of the plural A's being different comprises random-wise or block-wise distributed oxyalkylene groups;

wherein said branched alkyl group is represented by the general formula:

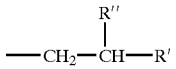

(5)

wherein R' and R" are the same or different straight-chain alkyl groups containing 8–18 carbon atoms.

3. The improver of claim 2, wherein said polymer (A0) has a solubility parameter of 8.6–9.4, a crystallizing initiation temperature of −15° C. or less, and a steric hindrance factor F of 0–13, said factor being defined by the following equation:

$$F=4X+Y \quad (1)$$

wherein X and Y represent the total atom numbers at the $6^{th}$ position and the $7^{th}$ position, respectively, in the side chains, counted from the backbone.

4. The improver of claim 2, wherein said polymer (A0) has a steric hindrance factor F of 0–10.

5. The improver of claim 2, wherein said polymer (A0) comprises 5–90% by weight of units of said monomer (a0), and 10–60% by weight of units of an alkyl acrylate or methacrylate (a2) containing 1–4 carbon atoms in the alkyl group, with or without 0–85% by weight of units of at least one selected from the group consisting of an alkyl acrylate or methacrylate (a3) containing 8–15 carbon atoms in the alkyl group, a branched alkyl acrylate or methacrylate (a12) containing 16–19 carbon atoms in the alkyl group, a straight-chain alkyl acrylate or methacrylate (a4) containing 16–18 carbon atoms in the alkyl group and a straight-chain alkyl acrylate or methacrylate (a5) containing 20–40 carbon atoms in the alkyl group.

6. The improver of claim 2, wherein said polymer (A0) comprises 10–45% by weight of units of 2-decyl-tetradecyl methacrylate, 20–45% by weight of units of methyl methacrylate, and 10–60% by weight of units of a straight-chain alkyl acrylate or methacrylate containing 10–18 carbon atoms in the alkyl group.

7. The improver of claim 2, wherein said polymer (A0) further comprises 0.1–10% by weight of units of a nitrogen-containing unsaturated monomer (d).

8. The improver of claim 7, wherein said monomer (d) is at least one selected from the group consisting of dimethylaminoethyl methacrylate, diethylaminoethyl methacrylate, morpholinoethyl methacrylate, and corresponding acrylates.

9. A viscosity improver concentrate, which comprises 10–90% by weight of said improver of claim 1 and 10–90% by weight of a diluent.

10. A viscosity improver concentrate, which comprises 10–90% by weight of said improver of claim 2 and 10–90% by weight of a diluent.

11. A lube oil composition, which comprises a major amount of a base oil and 0.5–30% by weight of said improver of claim 1.

12. The composition of claim 11, wherein the base oil has a kinematic viscosity of 1–15 $mm^2/s$ at 100° C. and a viscosity index of at least 80.

13. A lube oil composition, which comprises a major amount of a base oil and 0.5–30% by weight of said improver of claim 2.

14. The composition of claim 13, wherein the base oil has a kinematic viscosity of 1–15 $mm^2/s$ at 100° C. and a viscosity index of at least 80.

15. A compound of 2-decyl-tetradecyl methacrylate.

16. A compound of 2-decyl-tetradecyl acrylate.

17. A polymer having a weight-average molecular weight of 5,000–2,000,000, comprising units of a compound selected from the group consisting of a compound of 2-decyl-tetradecyl methacrylate and a compound of 2-decyl-tetradecyl acrylate.

18. The polymer of claim 17, which comprises 5–95% by weight of units of the compound of 2-decyl-tetradecyl methacrylate, and 5–95% by weight of units of at least one monomer selecting from the group consisting of: another alkyl methacrylate or an alkyl acrylate; and alkyl alkenyl ether; an alkenyl carboxylate; and a nitrogen-containing unsaturated monomer.

* * * * *

UNITED STATES PATENT AND TRADEMARK OFFICE

CERTIFICATE OF CORRECTION

PATENT NO. : 6,746,993 B2
DATED : June 8, 2004
INVENTOR(S) : Tsuyoshi Yuki et al.

It is certified that error appears in the above-identified patent and that said Letters Patent is hereby corrected as shown below:

Column 19,
Line 52, please correct the formula (2)

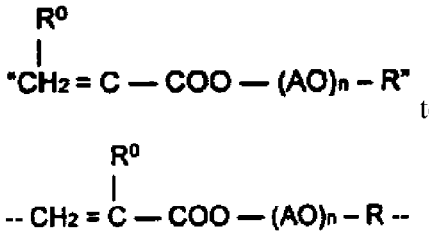

to

Column 20,
Line 18, please change "6$^{th}$" and "7$^{th}$" to -- 6th -- and -- 7th --.

Signed and Sealed this

First Day of March, 2005

JON W. DUDAS
*Director of the United States Patent and Trademark Office*